United States Patent [19]

Boom et al.

[11] 3,980,981

[45] Sept. 14, 1976

[54] SUPPORT STRUCTURE FOR RIPPLED SUPERCONDUCTING MAGNET

[75] Inventors: Roger W. Boom; Harold A. Peterson; Warren C. Young, all of Madison, Wis.

[73] Assignee: Wisconsin Alumni Research Foundation, Madison, Wis.

[22] Filed: Aug. 5, 1974

[21] Appl. No.: 494,712

[52] U.S. Cl. ..... 335/216; 174/15 CA

[51] Int. Cl.[2] ..... H01F 7/22

[58] Field of Search ..... 335/216, 299; 174/DIG. 6

[56] References Cited

UNITED STATES PATENTS

| | | | |
|---|---|---|---|
| 3,354,021 | 11/1967 | Royet | 174/DIG. 6 |
| 3,443,021 | 5/1969 | Schrader | 335/216 X |
| 3,444,495 | 5/1969 | Thomas | 335/216 X |
| 3,470,508 | 9/1969 | Donadieu et al. | 335/216 |
| 3,514,730 | 5/1970 | Kassner | 335/216 |

*Primary Examiner*—G. Harris

*Attorney, Agent, or Firm*—Theodore J. Long; John M. Winter; Harry C. Engstrom

[57] ABSTRACT

An electrical magnet having at least one turn of electrical conductor which is continuously rippled in small radius arcs around is larger circumference. Each ripple in the conductor is formed to lie in a plane normal to the net magnetic field experienced by that ripple. For the special case of a planar turn of conductor, the ripples lie in substantially the same plane as the conductor turn itself. When current is flowing in the rippled conductor, the conductor will experience a magnetically induced force directed outward normal to the conductor. To oppose this outwardly directed force, the conductor is provided support by means which engage the conductor at the inner portions of the conductor between the ripples therein. The support means may consist of members or columns extending to a solid circular wall as, for example, a wall formed in bedrock. The tensile load in the rippled conductor is much less than in an unsupported large radius circular conductor, and, in addition, the rippled conductor is capable of undergoing expansions and contractions without building up damaging strain levels in the conductor. A superconducting rippled conductor magnet may be thermally insulated from warm support structure by thermal shields and vacuum dewars which are also rippled.

6 Claims, 3 Drawing Figures

SUPPORT STRUCTURE FOR RIPPLED SUPERCONDUCTING MAGNET

BACKGROUND OF THE INVENTION

1. Field of the Invention

This invention pertains generally to the field of electrical magnets having support structure.

2. Description of the Prior Art

Energy storage with large superconducting magnets is one possible method of leveling the daily load requirements on present electric generating facilities. The excess energy generated during off-peak hours can be stored in such magnets and later returned to the power system during periods of high loads. Several studies have indicated that augmenting the generating equipment with energy storage devices can be more economical and energy-efficient than simply increasing the generating capacity of the power plants. See, e.g.: R. W. Boom and H. A. Peterson, "Superconductive Energy Storage for Power Systems," IEEE Transactions on Magnetics, Vol. MAG-8, No. 3, Sept. 1972, p. 701.

An energy storage or other large magnet may consist of multiple turns of conductor arranged, for example, in a solenoidal or toroidal configuration. The current flowing in the turns of the magnet produces a net magnetic field. The force on a short element of the conductor in this magnetic field is oriented at right angles to both the current and the magnetic field experienced by the element and is proportional to the products of the magnitudes of the current and the magnetic field. The net component of this force which is in the plane of a conductor turn is directed radially outward in general, and is the major force under consideration here. These forces can be very large in superconducting magnets because of the enormous currents that can be carried by superconductors. For example, if a turn of unsupported conductor in the magnet is substantially circular and planar, the tension at any cross-section in the conductor will be equal to BIR, where B is that component of the magnetic field experienced by the conductor which is perpendicular to the plane of the conductor (axial magnetic field), I is the current in the conductor, and R is the radius of curvature of the turn. The radius of the turns in energy storage magnets under consideration for power systems can be very large, in the range of 10 to 100 meters or more, so that the potential tensile load that an unsupported conductor must carry is very great. Moreover, if a circular conductor begins to yield, the increased radius of the turn causes the tension to increase, which makes the structure inherently unstable. Some external support means is thus necessary to support the conductor. The most commonly accepted support structure for circular turns is a hoop or cylinder of structural material which fits over the circular turn. Magnetically induced forces on the conductor will be opposed by tensile stresses in the conductor and in the external cylinder. This support cylinder must fit very closely over the conductor, since the conductor will experience strain if it must expand to conform to the surrounding cylinder. The cylinder must also resist the radial load with little accompanying strain, since increases in strain in the cylinder will be matched by increases in strain in the conductor in close contact therewith. For very large magnets, this conventional method of support would require massive and uneconomical amounts of structure, in addition to presenting the problem of maintaining close tolerances between the conductor and support structure which must both be of massive dimensions.

SUMMARY OF THE INVENTION

We have invented an electrical magnet which, for example can be used for storing large amounts of electrical energy at much less cost than magnets employing conventional support structures. Our invention has at least one turn of electrical conductor which is continuously rippled around the periphery thereof. The outwardly bowed ripples in the conductor are formed to lie in substantially the same plane as the conductor turn itself for the special case of a planar turn. In the more general case of a nonplanar turn, the ripples are formed to lie in a plane normal to the net magnetic field experienced by the ripple. The rippled conductor is provided radial support by support means which engage the conductor at the inner portions of the conductor, that is, at the portions of the conductor that are between the ripples and that extend furthest into the interior of the turn.

The support means can consist of structure which is entirely within the turn of conductor. This internal support structure is attached to the conductor at the inner portions thereof, and is stressed in tension as the conductor is forced outwards under the influence of a magnetic field. Alternatively, the support means may consist of external structure which is located entirely outside of the conductor turn. Such support can be achieved with support members or columns attached to the inner portions of the conductor, with these columns extending outward to a surrounding solid structure which absorbs the compressive loads transmitted by the columns. The surrounding structure can be constructed, for example, by forming a hole or trench in bedrock at much less expense than the construction of massive above ground structures. Moreover, by locating the conductor in a deep trench, any potential magnetic interference with the environment is minimized.

Most of the magnetically induced radial forces on the turns of conductor are transmitted to the support columns. The tension in the conductor itself at any point will be less than or equal to BIr, where B is the net axial magnetic field experienced by the conductor, I is the current in the conductor, and $r$ is the radius of curvature of the "ripples" between the support columns which preferably have the shape of a portion of a circle less than a semicircle. Since the radius r of the ripples is much smaller than the radius R of the turn, the tensile load at any point in our rippled conductor will be much less than in an unsupported circular conductor. Furthermore, if the outwardly bowed "ripple" portion of the conductor between the support columns does yield, the radius of curvature of the ripple actually becomes smaller, which decreases the tensile load in the conductor.

Because the conductor is rippled, it can fit easily into a somewhat irregular hole or other support structure. The rippled conductor can deform to adapt to the shape of the support structure without experiencing excessive strain, whereas a circular turn of conductor would experience considerable strain if its support structure were not perfectly circular and in intimate contact with the conductor. The low tolerance requirements of the rippled conductor are especially advantageous for magnets of large dimensions where close tolerances are difficult and expensive to maintain. The rippled conductor is, of course, also capable of deforming to accommodate thermal expansions and contractions and minor earth tremors, characteristics of major significance if earthen or bedrock support structure is to be used.

The rippled conductor may be a composite superconductor such as a superconducting niobium-titanium alloy embedded in a normal conductor such as copper or aluminum. The composite superconductor will typically be at 4.2°K or colder and must be insulated from the warm adjacent structure to minimize heat flow to the conductor. The insulation surrounding the cooled superconductor, including an outer and inner vacuum dewar, can also be rippled to allow an easy fit into the surrounding structure with maximum adaptability to any deformations in the shape of the structure.

Further objects, features and advantages of our invention will be apparent from the following detailed description taken in conjunction with the accompanying drawings showing preferred embodiments of a rippled conductor magnet exemplifying the principles of our invention.

DESCRIPTION OF THE PREFERRED EMBODIMENTS

Figure 1:
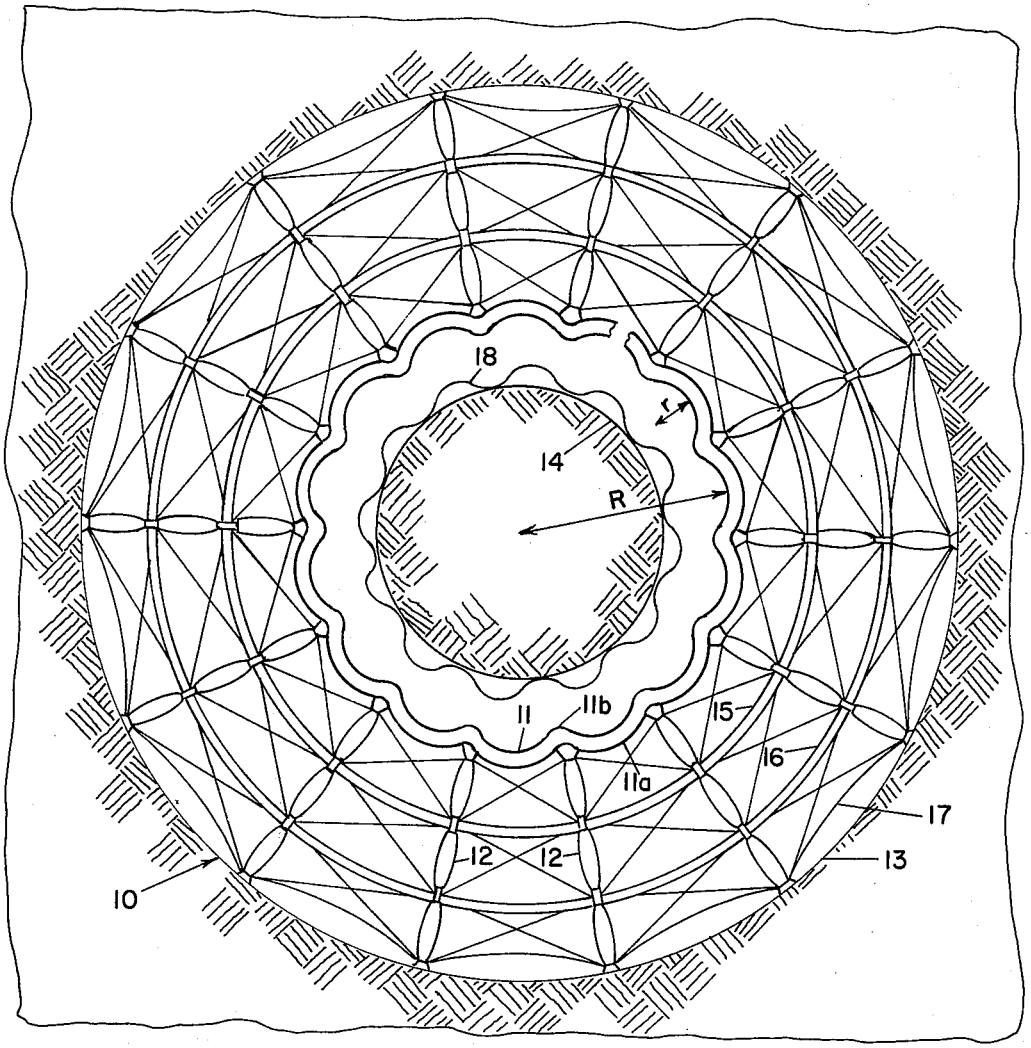
FIG. 1 is a top view of one turn of a rippled conductor magnet embodying the principles of our invention, shown emplaced in a bedrock support structure.
Figure 2:
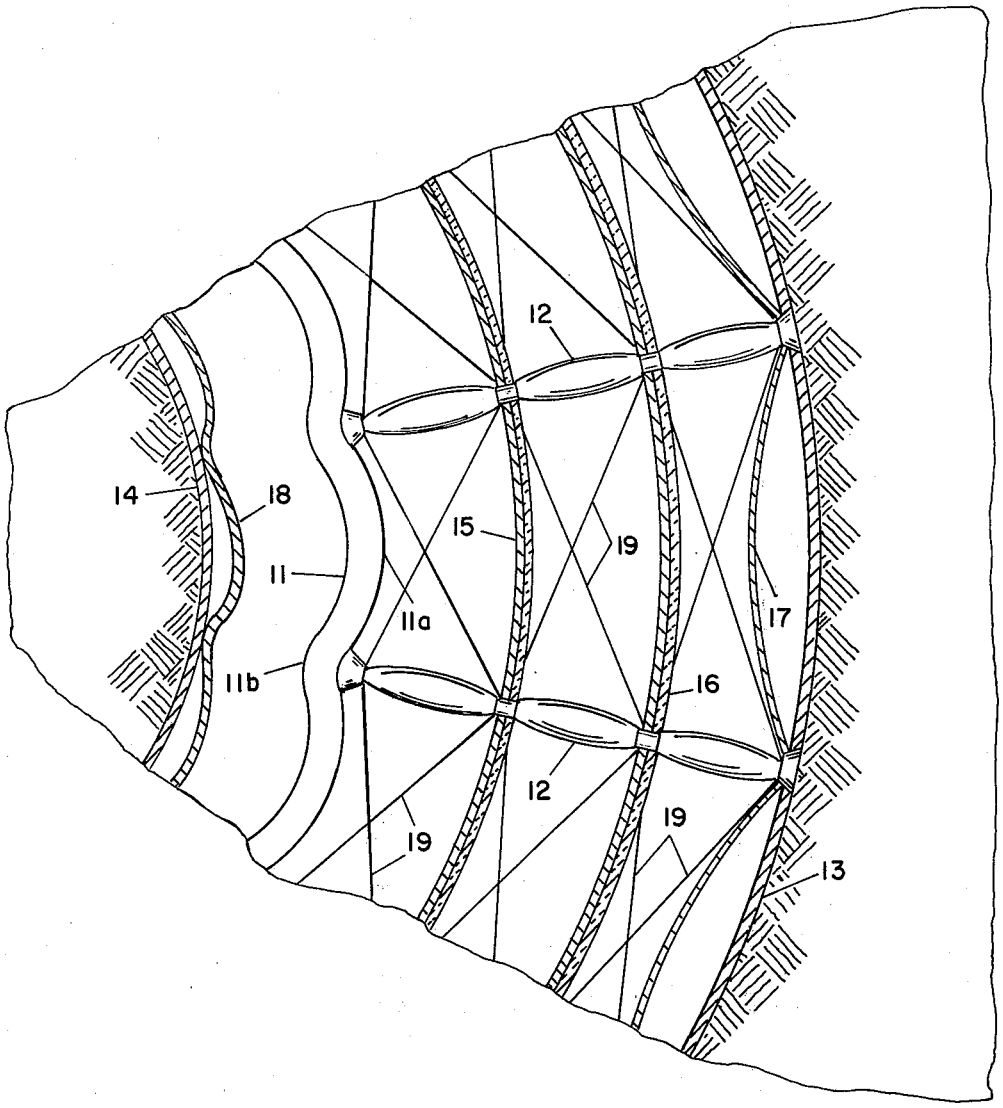
FIG. 2 is a detailed top view in cross-section of a portion of the rippled conductor magnet of FIG. 1.

Referring now more particularly to the drawings, wherein like numerals refer to like parts throughout the several views, a preferred embodiment of our rippled conductor magnet having substantially planar turns is shown generally at 10 in FIG. 1. The magnet 10 has an electrical conductor 11 formed into at least one turn which may have a substantially circular periphery as shown in FIG. 1. The conductor 11 has outwardly bowed undulations or ripples 11*a* therein which extend around the entire conductor turn. The ripples 11*a*, which preferably have the shape of a portion of a circle less than a semicircle, must lie in substantially the same plane as that in which the conductor turn itself lies For magnets having multiple turns of conductor, each individual turn will generally have the shape of a helix of low pitch, but will be considered herein to lie substantially in a single plane which is normal to the axis of the helix. When current is flowing in the conductor 11, the outward forces described above will be exerted on the conductor and it will tend to expand with each portion of the conductor tending to move outwardly away from the remainder of the turn. To restrain the rippled conductor 11 from large outward expansion, the conductor is supported at the inner portions 11*b* of the conductor, that is, the portions of the conductor 11 which are between the ripples 11*a* and which extend furthest into the interior of the turn. This support may be either internal or external to the conductor turn. Internal support means can comprise support columns, similar to the spokes of a wheel, which are attached to a central hub and are stressed in tension. However, for large magnets, the amount of expensive support structure can be reduced if means of support consists of external support members or columns 12 as shown in FIGS. 1 and 2 which extend radially outward from the conductor to meet with and be attachd to a structural mass that will resist the forces transmitted by the columns. Thus, when current is flowing in the conductor 11 the inner portions 11*b* will be substantially restrained from outward expansion by the columns 12 while the ripples 11*a* will be free to expand. It is apparent that for a smooth circular turn the increase in circumferential length due to magnetic forces is essentially unstable since the radius R of the circlar turn becomes larger and the tensile force T=BIR therefore is larger. However, for our supported rippled conductor, an increase in the circumferential length of a ripple 11*a* causes the ripple radius *r* to become smaller and therefore the tensile force T=BIr in the ripple is smaller, thus providing inherent stability.

For large magnets having a radius of curvature for a turn, R, of 10 meters or more, construction of external load bearing structure would become a significant portion of overall cost. However, a circular load bearing wall 13 can be economically formed by digging a circular hole or trench in solid earth or preferably bedrock. The circular conductor turn 11 is supported in the trench between the outer support wall 13 and an inner wall 14 as shown in FIG. 1. In general, the magnetic forces on current carrying conductors must be resisted by structure in tension. For a bedrock structural wall, in-situ stresses of a few hundred psi in compression should exist. Therefore, although pre-existing radial cracks in the bedrock might preclude tensile loads in the circumferential layer adjacent to the support wall 13, compression of rock wedges will carry the loading out to a much larger radius where the necessary tension can unload in-situ compression. The compressive load on each support column 12 from each turn of conductor will be approximately equal to BIA, where B is the axial magnetic field, I is the current in the conductor, and A is the circumferential spacing between the inner portions 11*b* on the conductor 11 where the support columns are attached. As indicated above, the maximum tensile force on the conductor between the support columns will be approximately equal to BIr, where *r* is the radius of the ripples 11*a*. The tensile force in the conductor can be reduced to manageable levels by decreasing the radius *r* of the ripples which may necessitate increasing the number of support columns.

It is anticipated that practical large magnets which may be used for storing large amounts of energy must employ superconductors. The rippled conductor 11, for example, may be a composite conductor composed of a niobium-titanium alloy embedded in a normal conductor such as copper or aluminum. Cooling of the composite conductor to superconducting temperatures can be accomplished by providing liquid or supercritical or superfluid helium to passageways in the conductor or to interstices between the turns. An insulating region must be provided to minimize heat flow from the surrounding rock to the composite conductor 11. As best shown in FIG. 2, two thermal insulating shields 15 and 16 preferably encircle the conductor 11 in the space between the conductor and the outer wall 13. These shields may be formed of a laminate of superinsulation and a metallic thermal radiation barrier as shown in FIG. 2. An outer vacuum dewar 17 is attached to the outer wall 13 to further insulate the normal temperature wall from the conductor. The dewar 17 is preferably rippled also, to thereby allow the dewar to accommodate any shifts in the bedrock wall or thermally induced dimension changes. The rippled dewar 17 will also initially fit easily into a large restraining structure such as a bedrock hole without the necessity of maintaining close tolerances. An inner vacuum dewar 18 may be attached to the inner bedrock wall 14 or it may be attached to the magnet support columns 12. It has the purpose of insulating the conductor from the warm core. The inner vacuum dewar 18 and top and bottom end pieces which are not shown would preferably also be rippled. To minimize heat flow through the support columns 12, the columns are preferably composed of low thermal conductivity material, possible epoxy-fiberglass. Bracing cables 19 as shown in FIG. 2 are provided to stabilize these support columns.

Figure 3:
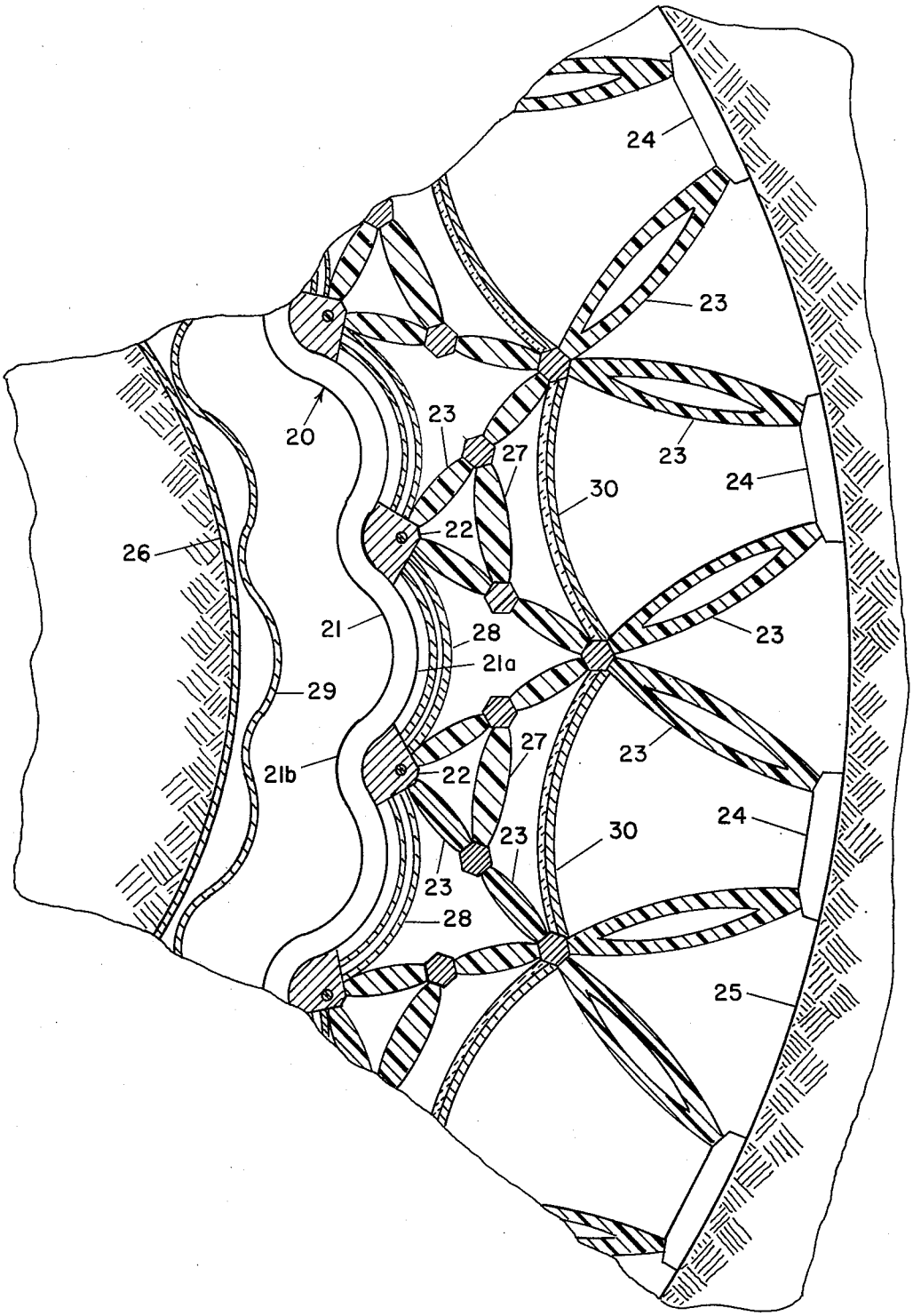
FIG. 3 is a detailed top view in cross-section of a portion of another embodiment of a rippled conductor magnet.

A portion of an alternative embodiment of our rippled conductor magnet having a somewhat different support means is shown generally at 20 in FIG. 3. The magnet 20 has at least one substantially circular turn of electrical conductor 21 which has outwardly bowed undulations or ripples 21*a* therein which extend around the periphery of the conductor turn in the manner described above for the conductor 11. Brackets 22 are attached to the inner portions 21*b* of the rippled conductor, and the brackets are themselves attached to support members 23 which extend outward from the brackets to footings 24 on an outer support wall 25. The support wall 25 can be formed as described above by excavating a circular hole or trench in earth or bedrock, with the conductor supported in a circular trench between the outer wall 25 and an inner wall 26. The support members 23 preferably crisscross and intersect as shown in FIG. 3 and have lateral members 27 attached to and between adjacent support members to thereby provide structural stability. The rippled conductor magnet 20 will thus accomodate magnetically induced forces in the same manner as described above for the rippled conductor magnet 10.

The support members 23 and the lateral member 27 should be composed of a low thermal conductivity material such as epoxy-fiberglass in order to minimize heat flow where the conductor 21 is a composite superconductor which must be cooled to extremely low temperatures. Thermal insulation of the conductor 21 from warm surrounding structure is provided by a rippled outer dewar 28 attached to the brackets 22 and a rippled inner dewar 29 which is attached to the inner wall 26. A rippled thermal insulating shield 30 encircles the conductor 21 in the space between the conductor and the outer wall. This shield may be formed of a laminate of super-insulation and a metallic thermal radiation barrier as shown in FIG. 3.

It is apparent from consideration of basic physical principles that the magnetically induced forces exerted on a small portion of any turn of conductor carrying current will be oriented normal to the conductor portion and will lie in a plane which is normal to the direction of the net magnetic field experienced by that portion of the conductor. For the case of a single planar conductor turn, the net self-induced magnetic field will usually be oriented approximately normal to the plane of the turn, and this condition will also hold true for the central turns of a multiple turn magnet such as a solenoid. Our rippled conductor magnets as described and illustrated above will function properly where the net magnetic field is in fact oriented normally to the plane of the turn. However, the planar end turns of a solenoid, for example, may experience magnetic fields whose orientation deviates considerably from a normal to the plane of the turn. It would thus be inappropriate to have the "ripples" in the conductor of these end turns lying in the plane of the turn, since the forces on the conductor would be oriented at an angle to that plane.

Although magnets are usually built with substantially planar turns, it is possible and often desirable for some purposes to build magnets whose conductor turns do not lie in a plane. Such non-planar magnet turns will also experience self-induced magnetic fields when current is flowing therein and will be subject to magnetically induced forces. In this more general case of a non-planar turn, the orientation and magnitude of the forces on the turn of conductor will vary greatly from point to point on the turn.

It is possible to utilize our rippled conductor principle for both non-planar magnet turns and planar turns subject to a magnetic field not normal to the plane of the turn. The application of the rippled conductor can be illustrated by considering a small segment of a turn of conductor. The net magnetic field experienced by a sufficiently small segment of conductor turn will be approximately uniform in magnitude and orientation throughout the small segment. In general, then, this small segment of conductor will preferably be rippled in a plane which is normal to the magnetic field experienced by the segment. The small segment of rippled conductor will be supported with support means as described above at the inner portions of the conductor between the ripples therein to restrain outward movements of the conductor primarily in the plane in which the ripples lie. The entire turn of conductor will preferably be rippled and supported in this manner, with each "ripple" in the conductor always being outwardly bowed and lying substantially in a plane which is normal to the net magnetic field which is experienced by the ripple when current is flowing in the conductor.

Although we have shown our rippled conductor magnet 10 and our magnet 20 as having a simple solenoid coil shape, it is apparent that rippled conductor magnets can be formed in any other desired coil configuration such as a toroid, dipole, etc. Each turn in these other coil configurations is rippled as described above, and is supported by external or internal structure attached to the innermost portions of the rippled conductor.

It is understood that our invention is not confined to the particular construction and arrangement of parts herein illustrated and described, but embraces all such modified forms thereof as come within the scope of the following claims.

We claim:

1. An electrical magnet, comprising:

a. at least one turn of composite conductor having outwardly bowed ripples therein and inner portions between said ripples, each of said ripples lying substantially in a plane normal to the net magnetic field experienced by said ripples when current is flowing in said composite conductor, said composite conductor being formed of a superconducting material and a normal conducting material;

b. a support wall formed of structural material which substantially surrounds the outer periphery of said turn of composite conductor in spaced relation thereto; and c. a plurality of support members composed of a low thermal conductivity material, at least one support member attached to each of said inner portions of said composite conductor, said support members extending from said composite conductor to attachment with said support wall.

2. The electrical magnet as specified in claim 1 including an outer vacuum dewar which surrounds the outer periphery of and is spaced away from said composite conductor and an inner vacuum dewar within and spaced away from the inner periphery of said composite conductor, said inner and outer vacuum dewars being continuously rippled around their periphery.

3. The electrical magnet as specified in claim 1 wherein said ripples in said composite conductor have substantially the shape of a portion of a circle less than a semicircle.

4. An electrical magnet, comprising:

a. at least one substantially planar turn of composite conductor having outwardly bowed ripples therein throughout said turn and inner portions between said ripples, said ripples lying in substantially the same plane as that in which said turn of conductor lies, said composite conductor being formed of a superconducting material and a normal conducting material;

b. a support wall defining a hole formed in solid earth, said support wall substantially surrounding said turn of composite conductor around the periphery thereof in spaced relation thereto; and c. a plurality of support members composed of a low thermal conductivity material, at least one support member attached to each of said inner portions of said composite conductor, said support members extending from said composite conductor to attachment with said support wall.

5. The electrical magnet as specified in claim 4 including an outer vacuum dewar which surrounds the outer periphery of and is spaced away from said composite conductor and an inner vacuum dewar within and spaced away from the inner periphery of said composite conductor, said inner and outer vacuum dewars being continuously rippled around their periphery.

6. The electrical magnet as specified in claim 4 wherein said ripples in said composite conductor have substantially the shape of a portion of a circle less than a semicircle.

* * * * *